US011776738B2

(12) United States Patent
Nichols et al.

(10) Patent No.: US 11,776,738 B2
(45) Date of Patent: Oct. 3, 2023

(54) SUPERCONDUCTING SHIELD FOR CRYOGENIC CHAMBER

(71) Applicant: Quantinuum LLC, Broomfield, CO (US)

(72) Inventors: C. Spencer Nichols, Marietta, GA (US); Chad Langness, Golden Valley, MN (US); Adam Dally, Champlin, MN (US); James Goeders, Minneapolis, MN (US)

(73) Assignee: Quantinuum LLC, Broomfield, CO (US)

( * ) Notice: Subject to any disclaimer, the term of this patent is extended or adjusted under 35 U.S.C. 154(b) by 876 days.

(21) Appl. No.: 16/704,210

(22) Filed: Dec. 5, 2019

(65) Prior Publication Data

US 2021/0175010 A1 Jun. 10, 2021

(51) Int. Cl.

| | |
|---|---|
| ***H01F 27/36*** | (2006.01) |
| ***H01F 6/04*** | (2006.01) |
| ***F25D 31/00*** | (2006.01) |
| ***F25D 19/00*** | (2006.01) |
| ***F25D 23/00*** | (2006.01) |
| ***H01F 6/06*** | (2006.01) |

(52) U.S. Cl.

CPC ..... *H01F 27/36* (2013.01); *F25D 19/006* (2013.01); *F25D 23/00* (2013.01); *F25D 31/00* (2013.01); *H01F 6/04* (2013.01); *H01F 6/06* (2013.01)

(58) Field of Classification Search

CPC ... H01F 27/36; H01F 6/04; H01F 6/06; F25D 19/006; F25D 23/00; F25D 31/00; G06N 10/00

See application file for complete search history.

(56) References Cited

U.S. PATENT DOCUMENTS

| | | | | |
|---|---|---|---|---|
| 2009/0168286 | A1* | 7/2009 | Berkley | H05K 9/0077 361/141 |
| 2011/0009274 | A1* | 1/2011 | Uchaykin | H05K 9/0077 505/150 |
| 2011/0237442 | A1* | 9/2011 | Uchaykin | H05K 9/0071 505/234 |
| 2017/0178018 | A1* | 6/2017 | Tcaciuc | H01F 41/076 |
| 2019/0182995 | A1* | 6/2019 | Sterling | H05K 9/0077 |

FOREIGN PATENT DOCUMENTS

JP H0758491 A * 3/1995

OTHER PUBLICATIONS

List of Superconductors, [online][retrieved Mar. 4, 2020]. Retrieved from the Internet: URL: https://en.wikipedia.org/wiki/List_of_superconductors, 9 pages.

* cited by examiner

*Primary Examiner* — Daniel R Miller
(74) *Attorney, Agent, or Firm* — ALSTON & BIRD LLP

(57) ABSTRACT

A shield for a cryogenic chamber and a cryogenic chamber comprising a shield are described. In an example embodiment, a cryogenic chamber comprises an interior housing comprising housing walls that define an action chamber. The action chamber is configured to be cryogenically cooled to an action temperature. The cryogenic chamber further comprises an interior shield at least partially sandwiched within the housing walls. The interior shield is made of a first material that acts as a superconductor at the action temperature.

19 Claims, 9 Drawing Sheets

SUPERCONDUCTING SHIELD FOR CRYOGENIC CHAMBER

FEDERALLY SPONSORED RESEARCH OR DEVELOPMENT

Figure 1:
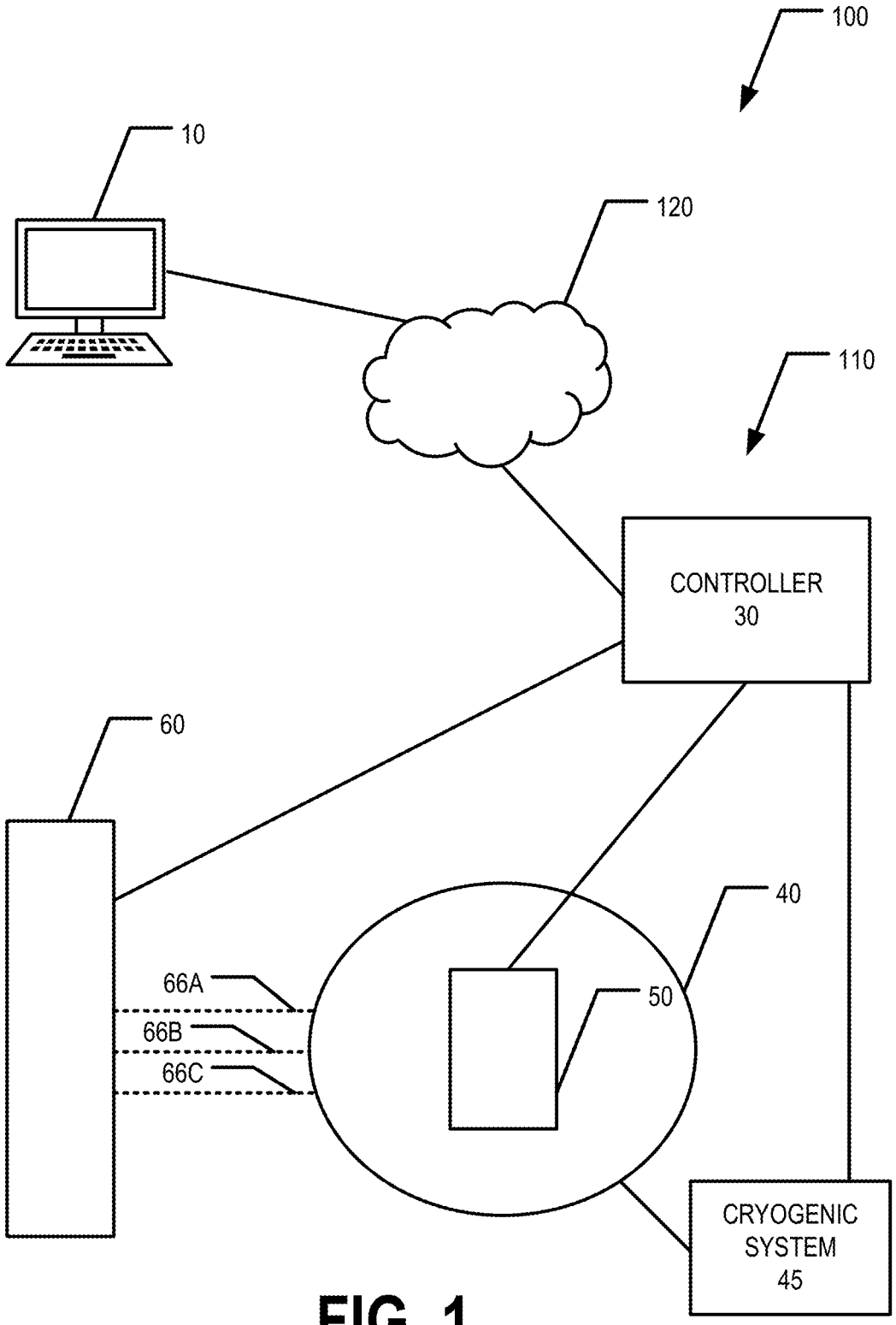

This invention was made with United States Government support. The United States Government has certain rights in the invention.

TECHNICAL FIELD

Various embodiments relate to shield for a cryogenic chamber. For example, various embodiments relate to a shield configured to provide a highly uniform magnetic field region within a cryogenic chamber.

BACKGROUND

In various scenarios, an action (e.g., experiment, controlled state evolution, reaction, function performance, and/or the like) is to be carried out an action temperature that is a cryogenic temperature. Generally, temperatures in the range of 0 K to 124 K are considered cryogenic temperatures. Some of these actions require precise control of other environmental parameters in addition to temperature. For example, the action may require being performed within a region where the magnetic field is substantially free of fluctuations. However, the Earth's magnetic field and/or magnetic fields generated by electrical components in the vicinity of where the action is taking place may cause the local magnetic field to have significant fluctuations.

BRIEF SUMMARY OF EXAMPLE EMBODIMENTS

Example embodiments provide methods for shielding a cryogenic chamber, a cryogenic chamber comprising a superconducting shield, a superconducting shield for use with a cryogenic chamber, and/or the like. In various embodiments, the cryogenic chamber may comprise an action chamber within which one or more actions may be performed corresponding action temperatures. For example, the actions may include performing an experiment, a controlled state evolution, a chemical reaction, performing a function, and/or the like. In various embodiments, the action temperatures are cryogenic temperatures (e.g., within the range of 0 K to 124 K).

According to a first aspect, a shield for a cryogenic chamber is provided. In an example embodiment, the shield comprises an interior shield at least partially sandwiched within housing walls of the cryogenic chamber. The housing walls define an action chamber within the cryogenic chamber. The action chamber is configured to be cryogenically cooled to an action temperature. The interior shield is made of a first material that acts as a superconductor at the action temperature.

According to another aspect, a cryogenic chamber comprising a shield is provided. In an example embodiment, the cryogenic chamber comprises an interior housing comprising housing walls that define an action chamber. The action chamber is configured to be cryogenically cooled to an action temperature. The cryogenic chamber further comprises an interior shield at least partially sandwiched within the housing walls. The interior shield is made of a first material that acts as a superconductor at the action temperature.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 provides a schematic diagram of an example action system, in accordance with an example embodiment.

Figure 2:
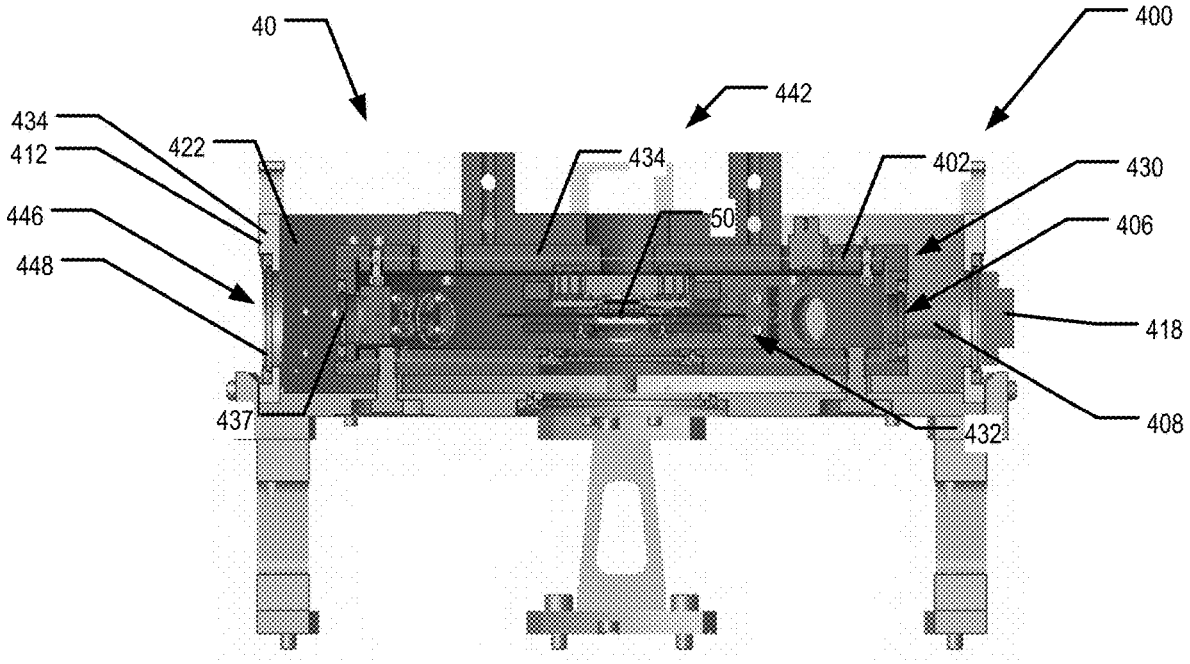

FIG. 2 provides a cross-section view of an example cryogenic chamber, in accordance with an example embodiment.

Figure 3:
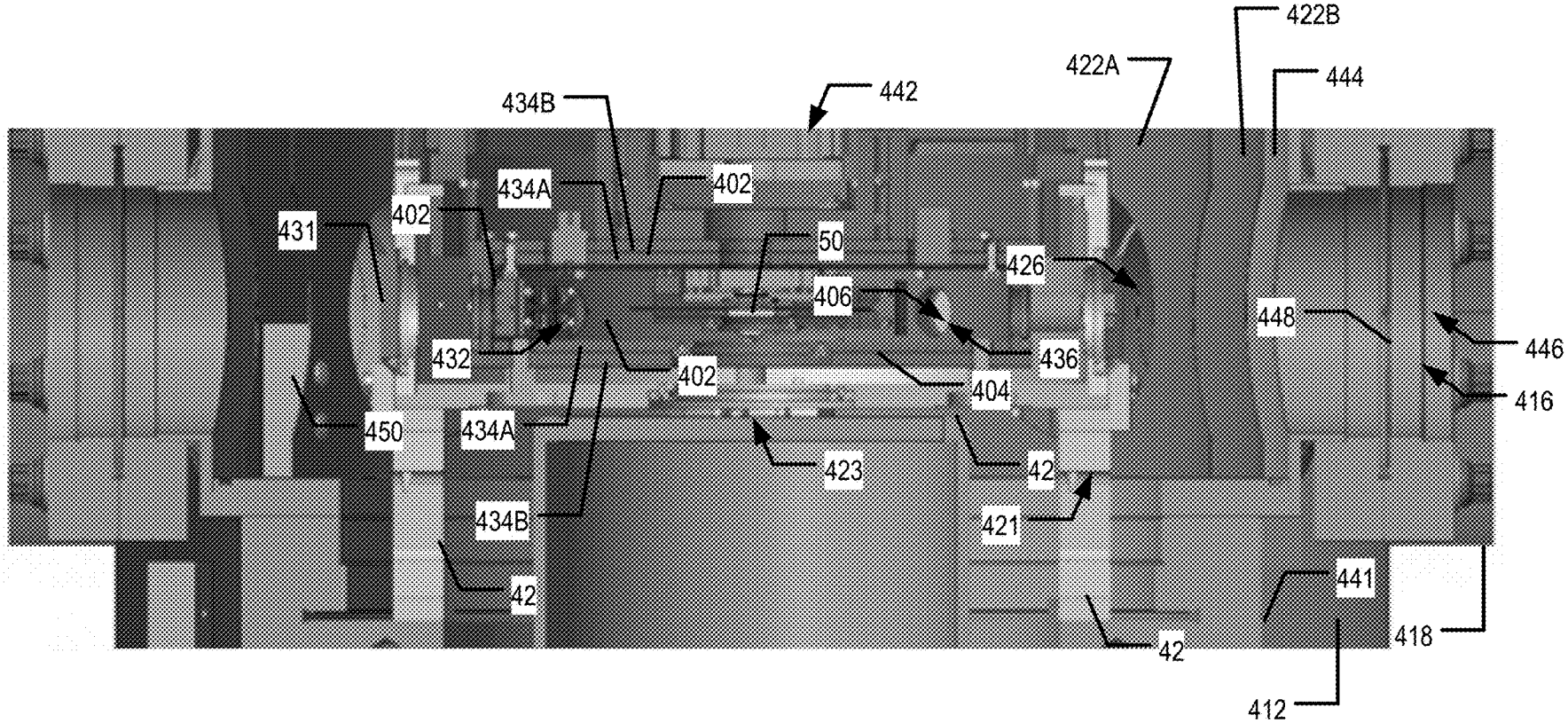

FIG. 3 provides a cross-section view of another example cryogenic chamber, in accordance with an example embodiment.

Figure 4:
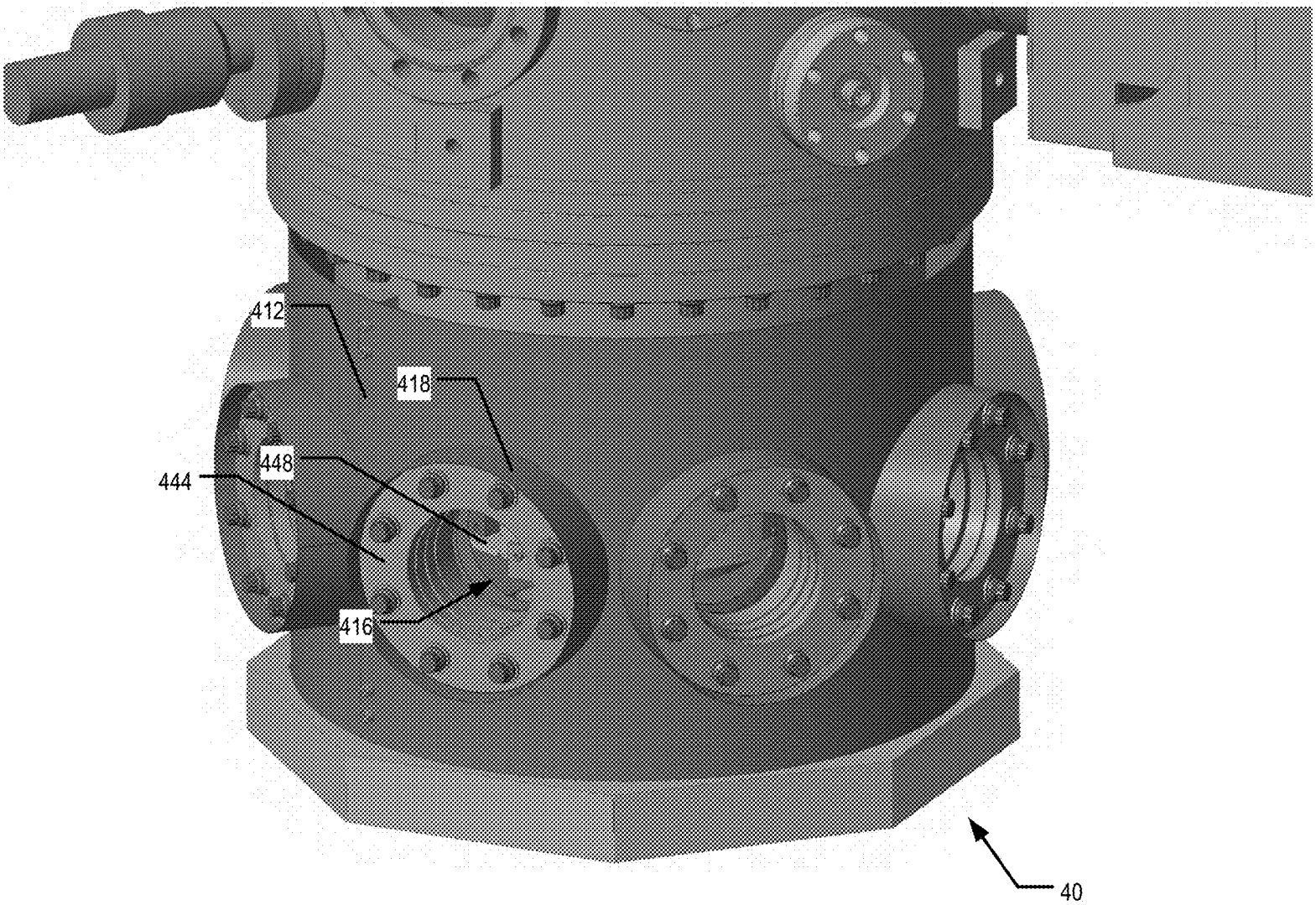

FIG. 4 provides a perspective view of an example cryogenic chamber, in accordance with an example embodiment.

Figure 5:
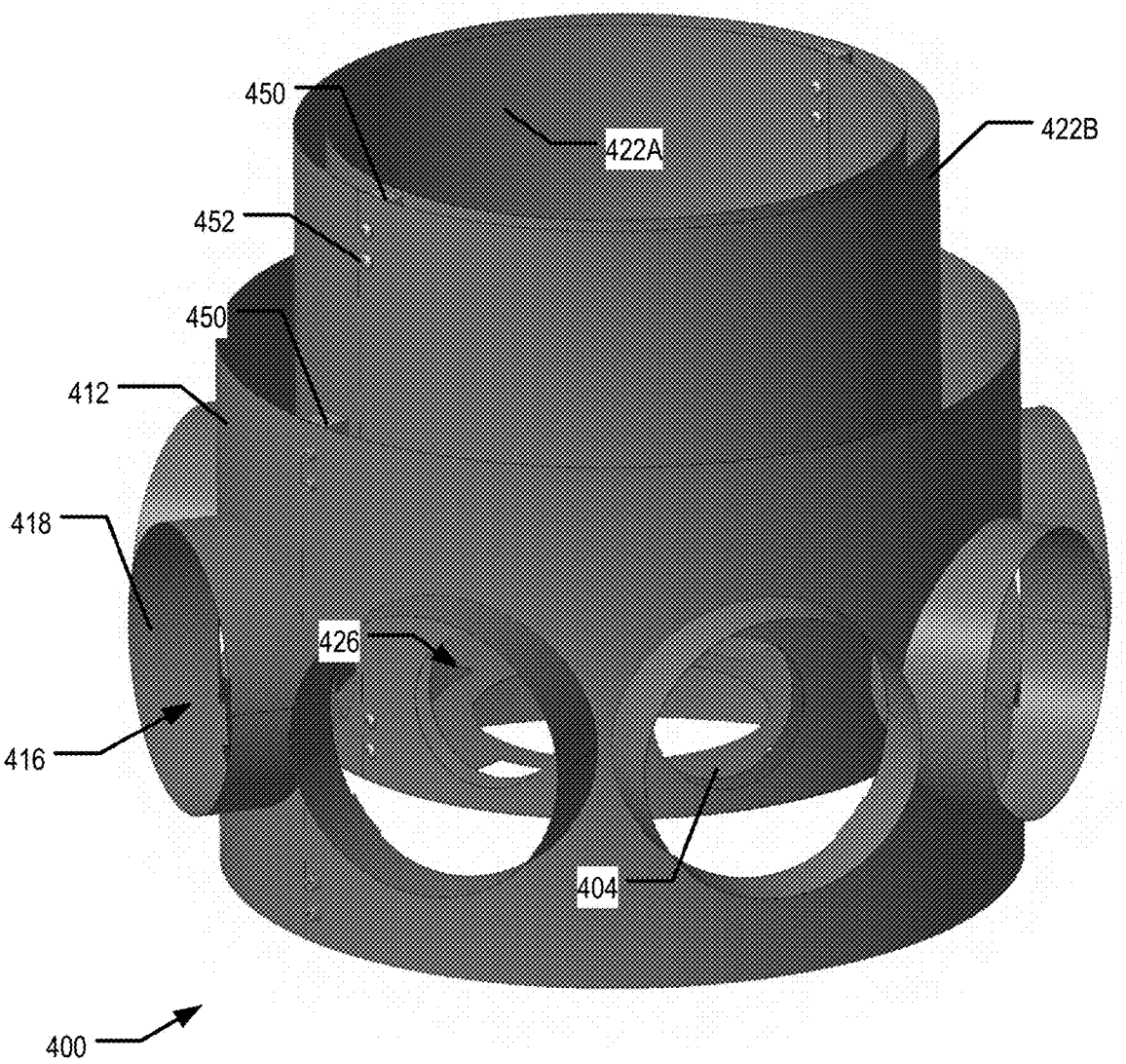

FIG. 5 provides a perspective view of shield for a cryogenic chamber, in accordance with an example embodiment.

Figure 6:
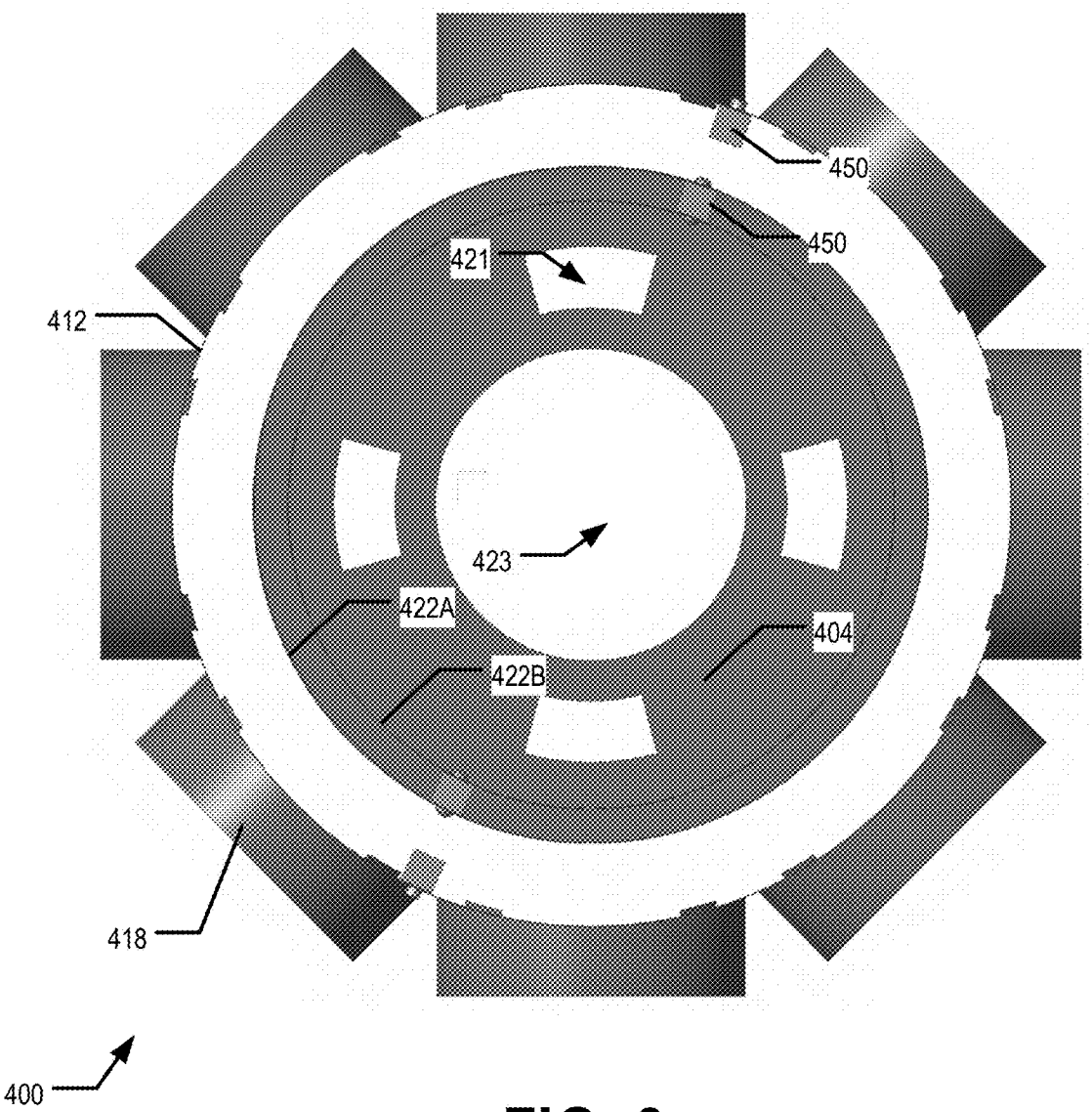

FIG. 6 provides a top view of the shield shown in FIG. 5.

Figure 7:
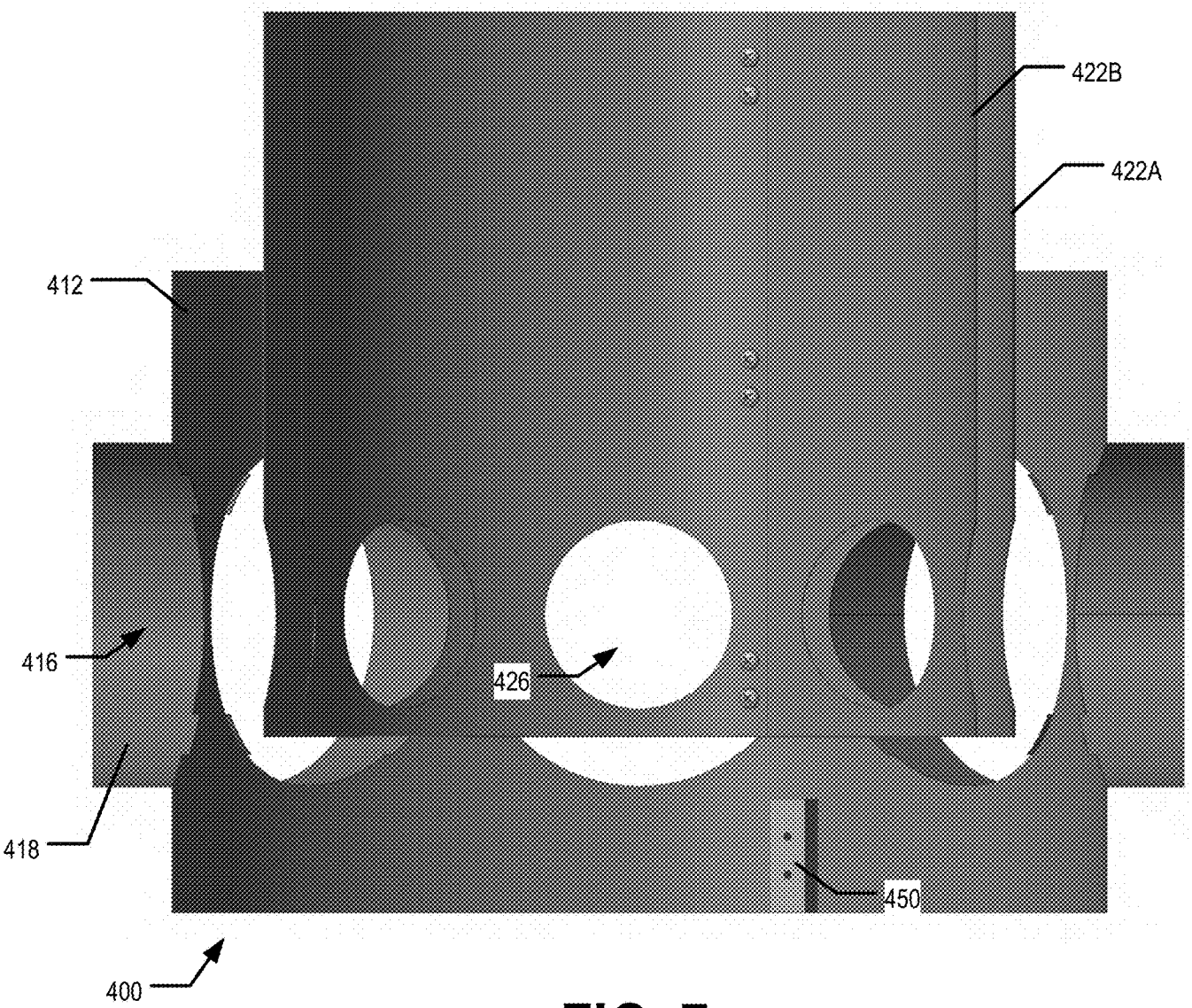

FIG. 7 provides a partial cross-section view of the shield shown in FIG. 5.

Figure 8:
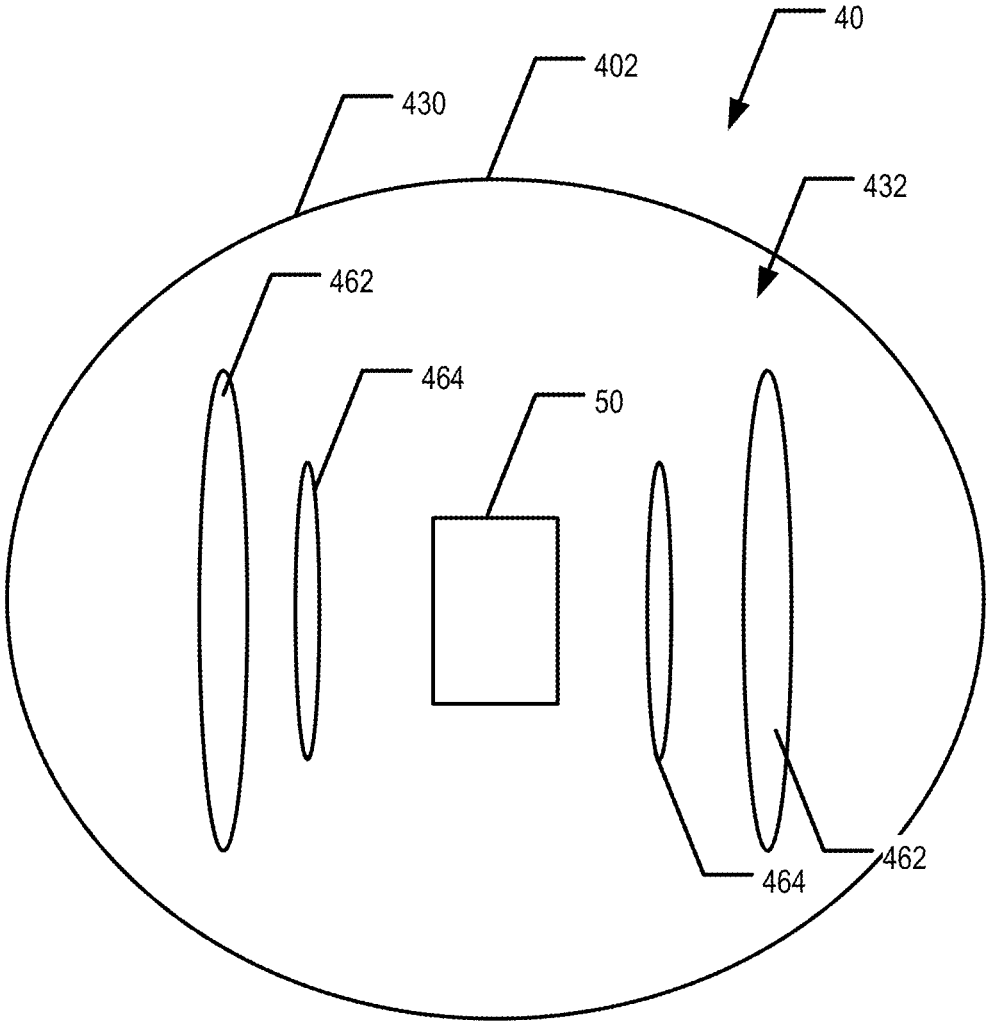

FIG. 8 provides a schematic diagram of an example action chamber within an interior housing, in accordance with an example embodiment.

Figure 9:
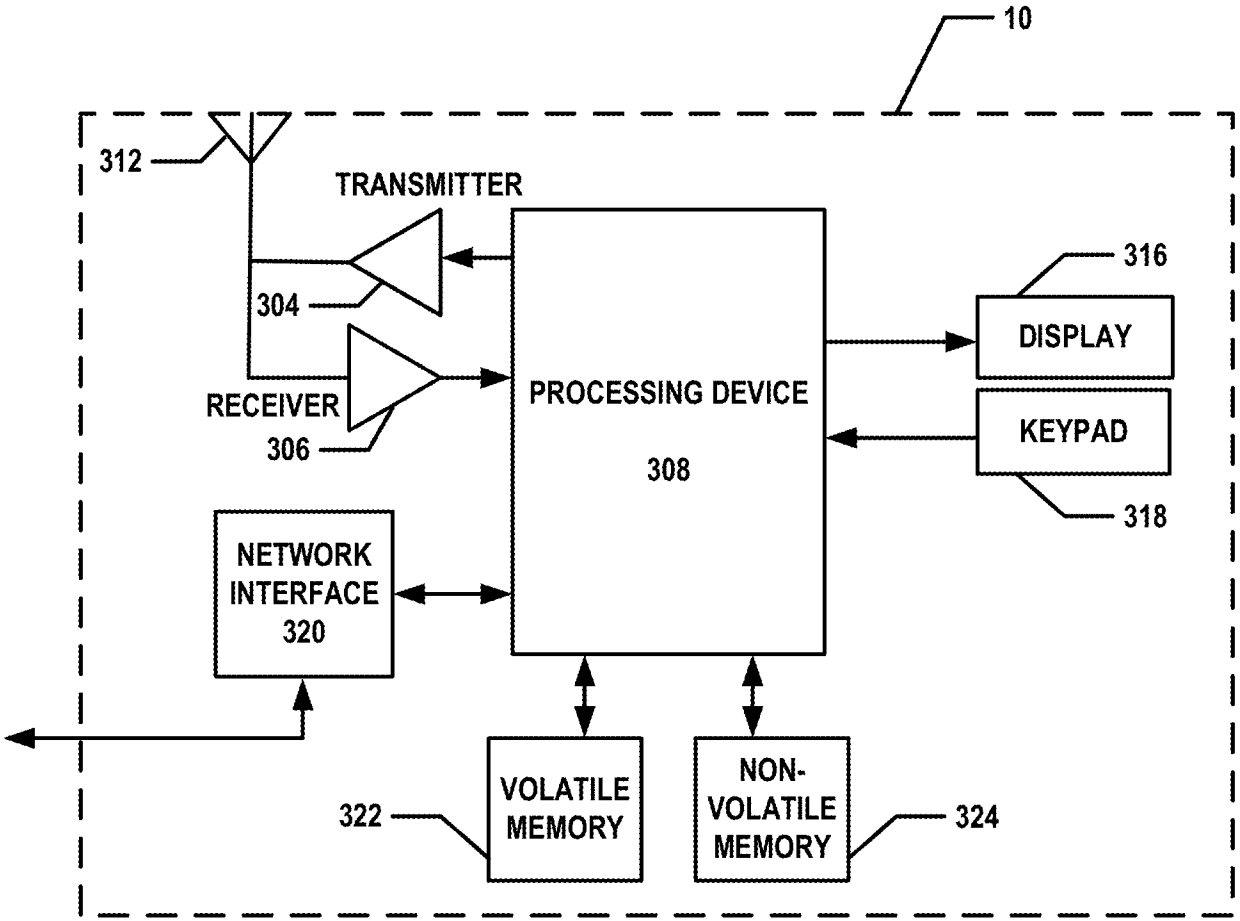

FIG. 9 provides a schematic diagram of an example computing entity that may be used in accordance with an example embodiment.

DETAILED DESCRIPTION OF SOME EXAMPLE EMBODIMENTS

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. The term "or" (also denoted "/") is used herein in both the alternative and conjunctive sense, unless otherwise indicated. The terms "illustrative" and "exemplary" are used to be examples with no indication of quality level. The terms "generally" and "approximately" refer to within engineering and/or manufacturing limits and/or within user measurement capabilities, unless otherwise indicated. Like numbers refer to like elements throughout.

As described above, in various cryogenic systems, it is important to be able to precisely control the magnetic field within an action chamber of the cryogenic system. For example, to accurately carry out an action within the action chamber of the cryogenic system, the magnetic field in the action chamber may be controlled to have very few and/or very small fluctuations. In various embodiments, the cryogenic chamber of the cryogenic system comprises a shield configured to dampen, reduce, diminish, and/or minimize fluctuations in the magnetic field within the action chamber. In various embodiments, the shield comprises an interior shield that is at least partially embedded within an interior housing of the cryogenic chamber that defines the action chamber. In various embodiments, the interior shield is made of a first material that acts as a superconductor (e.g., has approximately zero resistivity) at an action temperature. The cryogenic system is configured to maintain the action chamber at the action temperature.

In various embodiments, the action chamber is defined by an interior housing of the cryogenic chamber. For example, the interior housing may be disposed within the cryogenic chamber. The interior housing may comprise housing walls that define the action chamber within the interior housing. In various embodiments, the shield comprises an interior shield that is at least partially sandwiched within the housing walls of the interior housing. For example, at least some of the housing walls of the interior housing may comprise an exterior wall portion and an interior wall portion. At least a portion of the interior shield may be sandwiched between the exterior wall portion and the interior wall portion, in an example embodiment. In various embodiments, the interior shield comprises at least one sheet or film of a first material. In various embodiments, the first material is a metal, metal alloy, and/or the like. In various embodiments, the first material is a superconductor at the action temperature. For example, in an example embodiment where the action temperature is a cryogenic temperature (e.g., less than approximately 124 K).

In various embodiments, the cryogenic chamber comprises an outer housing that defines a main chamber of the cryogenic chamber. For example, the interior housing and the action chamber are disposed within the main chamber of the cryogenic chamber. In various embodiments, an exterior shield is disposed outside of the outer housing. For example, the exterior shield may comprise at least one sheet of a second material that dads the outer surface of the outer housing. In various embodiments, the second material is a metal, metal alloy, and/or other low resistivity material. In various embodiments, the second material may be different from the first material of the interior shield. In various embodiments, the exterior shield is expected to be at an outer shield temperature when the action chamber is maintained at the action temperature (e.g., by a cryogenic system). In various embodiments, the second material has low resistivity and/or is a superconductor at the outer shield temperature. In an example embodiment, the outer shield temperature is in the range of approximately 30-100K. In an example embodiment, the outer temperature is approximately 40 K.

In various embodiments, one or more intermediate shields may be disposed between an inner surface of the outer housing and the housing walls of the interior housing. In an example embodiment, two intermediate shields are disposed between the inner surface of the outer housing and the housing walls of the interior housing. For example, an intermediate shield may be disposed within the main chamber and outside of the interior housing. In various embodiments, an intermediate shield comprises at least one sheet of a third material. The third material may be a metal, metal alloy, and/or other low resistivity material. In various embodiments, the third material may be different from the first material of the interior shield and/or the second material of the outer shield. In various embodiments, the intermediate shield is expected to be at an intermediate temperature when the action chamber is maintained at the action temperature (e.g., by a cryogenic system). In various embodiments, the third material has low resistivity and/or is a super conductor at the intermediate temperature. In an example embodiment, the intermediate temperature is in the range of approximately 30-100K. In an example embodiment, the intermediate temperature is 40 K.

In various embodiments, the interior housing and outer housing include one or more access openings. In various embodiments, the access openings may provide an optical path for a laser beam to enter the action chamber for use in the action, provide an optical path for photons generated during the action to leave the action chamber, permit a fiber optic or electrical cable to pass through the outer and/or interior housing, and/or the like. In various embodiments, the interior, outer, and/or intermediate shields comprise shield openings corresponding to access openings. For example, the interior shield comprises a shield opening corresponding to each access opening of the interior housing. For example, the exterior shield comprises a shield opening corresponding to each access opening of the outer housing. In various embodiments, the intermediate shield may comprise a shield opening corresponding to each access opening of the interior and/or outer housing. In an example embodiment, the interior shield, intermediate shield, and/or exterior shield comprises a tube stub extending outward from the shield opening. For example, a tube stub may be hollow cylinder having substantially the same or smaller diameter as the shield opening. The tube stub may be secured to the corresponding shield at the perimeter of the shield opening and extend outward from the shield. In various embodiments, a tube stub is made of the same material as the corresponding shield and is in electrical contact with the corresponding shield.

In various embodiments, the shield comprises an interior shield at least partially sandwiched within the housing walls of the interior housing of a cryogenic chamber. In various embodiments, the shield further comprises an exterior shield and/or an intermediate shield. In various embodiments, the interior shield comprises one or more tube stubs about a shield opening therein. In various embodiments, the exterior shield and/or the intermediate shield comprises one or more tube stubs about a shield opening therein. In various embodiments, the shield is configured to provide a very homogenous magnetic field region within the action chamber. For example, the shield may be configured to reduce, diminish, and/or minimize magnetic field fluctuations within the action chamber. In various embodiments, the action chamber is configured to be maintained at an action temperature which is a cryogenic temperature (e.g., via a cryogenic system). In various embodiments, the interior shield is made of a first material that is a super conductor at the action temperature.

In an example embodiment, the cryogenic system is part of a quantum computer, such as a trapped ion quantum computer. In an example embodiment, the actions include preparing one or more qubits of the quantum computer (e.g., within an ion trap), performing a controlled state evolution of one or more qubits of the quantum computer (e.g., via application of one or more gates), stimulating emission of one or more qubits of the quantum computer (e.g., to read the qubit), and/or the like.

Exemplary Quantum Computer System

FIG. 1 provides a schematic diagram of an example trapped ion quantum computer system 100, in accordance with an example embodiment. In various embodiments, the trapped ion quantum computer system 100 comprises a computing entity 10 and a quantum computer 110. In various embodiments, the quantum computer 110 comprises a controller 30, a cryogenic chamber 40 enclosing an ion trap 50, and one or more laser sources 60. In various embodiments, the one or more laser sources 60 are configured to provide one or more laser beams to the ion trap 50 within an action chamber 432 (See FIG. 3) of the cryogenic chamber 40. In an example embodiment, the cryogenic chamber and/or a portion thereof (e.g., including the action chamber) is also a vacuum chamber.

In various embodiments, a computing entity 10 is configured to allow a user to provide input to the quantum computer 110 (e.g., via a user interface of the computing entity 10) and receive, view, and/or the like output from the quantum computer 110. The computing entity 10 may be in communication with the controller 30 via one or more wired or wireless networks 120 and/or via direct wired and/or wireless communications. In an example embodiment, the computing entity 10 may translate, configure, format, and/or the like information/data, quantum computing algorithms, and/or the like into a computing language, executable instructions, command sets, and/or the like that the controller 30 can understand and/or implement.

In various embodiments, the controller 30 is configured to control the ion trap 50, cryogenic system 45 and/or vacuum system controlling the temperature and pressure within the cryogenic chamber 40, and/or other systems controlling the environmental conditions (e.g., temperature, humidity, pressure, and/or the like) within the cryogenic chamber 40. For example, the cryogenic system 45 may be configured to maintain the action chamber 432 at the action temperature. In various embodiments, the action temperature is a cryogenic temperature (e.g., in the range of approximately 124 K to 0 K) and the cryogenic system 45 is a cryogenic cooling system. In various embodiments, the cryogenic system 45 is also comprises a vacuum system configured to maintain the main chamber 442 and/or the action chamber 432 at a particular pressure. In various embodiments, the controller 30 is configured to control various components of the quantum computer 110 in accordance with executable instructions, command sets, and/or the like provided by the computing entity 10. In various embodiments, the controller 30 is configured to receive output from the quantum computer 110 (e.g., from an optical collection system) and provide the output and/or the result of a processing the output to the computing entity 10.

In various embodiments, the one or more laser sources 60 are configured to generate laser beams and provide the laser beams to the cryogenic chamber 40 (and/or the action chamber 432) via one or more optical fibers 64 (e.g., 64A, 64B, 64C), such that laser beams are accurately and precisely delivered to qubit ions within the ion trap 50 (e.g., precisely in terms of position, frequency, and/or phase). In various embodiments, the optical fibers 64 and/or other optical path and/or wave guide may provide the laser beams to the ion trap 50 and/or action chamber 432 via one or more access openings 446 and/or shield openings 406, 416, 426 (See FIGS. 2-7).

Exemplary Cryogenic Chamber

FIGS. 2-4 and 8 provide various views of a cryogenic chamber 40 and FIGS. 5-7 provide various views of outer and intermediate shields 412, 422 (e.g., 422A, 422B). In various embodiments, the cryogenic chamber 40 comprises an interior housing 434 and an outer housing 440. In various embodiments, the interior housing 430 comprises housing walls 434. The housing walls 434 define an action chamber 432. In various embodiments, one or more actions may be performed within the action chamber at a corresponding action temperature. For example, the actions may include performing an experiment, a controlled state evolution, a chemical reaction, performing a function, and/or the like. In an example embodiment, the ion trap 50 of an ion trapped quantum computer 110 is disposed within the action chamber 432. In various embodiments, the outer housing 440 defines a main chamber 442. The interior housing 430 and the action chamber 432 are disposed within the main chamber 442. In various embodiments, the interior housing 430 and/or the outer housing 440 are made of metal. For example, the interior housing 430 and/or the outer housing 440 may be made of copper.

The cryogenic chamber is coupled to a cryogenic system configured to maintain the action chamber 432 and/or the interior housing 430 at an action temperature. When the action chamber 432 is maintained at the action temperature the outer housing 440 is maintained at a second temperature. In various embodiments, the action temperatures are cryogenic temperatures (e.g., within the range of 0 K to 124 K). In an example embodiment, the action temperature is approximately 4 K. In an example embodiment, the second temperature is 40 K.

In various embodiments, the inner housing 430 and/or the outer housing 440 comprise access openings 436, 446. In various embodiments, the access openings 436, 446 allow for laser beams to enter the main chamber 442 and/or the action chamber 432; fiber optics and/or electrical cables (e.g., 46A, 46B, 46C) to provide laser beams, electrical signals, and/or the like to the inside of main chamber 442 and/or the action chamber 432; and/or the like. In various embodiments, the access openings 436, 446 may be enclosed by a transparent (e.g., transparent at the wavelength of a laser beam being provided to the main chamber and/or action chamber) and/or translucent window 437, 448.

In various embodiments, the cryogenic chamber 40 is configured to insulate the action chamber 432 such that the action chamber 432 may be maintained at the action temperature by the cryogenic system 45. In various embodiments, the cryogenic chamber 40 is configured to seal the main chamber 442 and/or action chamber 432 from the external environment that is exterior to the cryogenic chamber 40 such that the pressure within the main chamber 442 and/or action chamber 432 may be controlled independently of the external environment. For example, the cryogenic chamber 40 may be a vacuum chamber.

In various embodiments, the cryogenic chamber 40 comprises a shield 400. The shield 400 is configured to cause the magnetic field within the action chamber 432 to have very few and/or very small fluctuations such that the magnetic field within the action chamber 432 is highly uniform and/or homogenous. In various embodiments, the shield 400 comprises an interior shield 402. In various embodiments, the shield 400 may further comprise and exterior shield 412 and/or one or more intermediate shields 422 (e.g., 422A, 422B). In an example embodiment, the shield 400 may further comprise an end shield 404. In various embodiments, each of the interior shield 402, exterior shield 412, and/or one or more intermediate shields is generally a cylindrical shell. The end shield 404 encloses one end of the cylindrical shell of the interior shell 402. For example, the end shield 404 may be disposed at one end of the cylindrical shell of the interior shell 402 and may be at least partially sandwiched between one or more layers of the end wall of the interior housing 232, in an example embodiment.

In various embodiments, the action chamber 432 is defined by an interior housing 430 of the cryogenic chamber 40. For example, the interior housing 432 may be disposed within the main chamber 442 of the cryogenic chamber 40. The interior housing 430 may comprise housing walls 434 that define the action chamber 432 within the interior housing 430. In various embodiments, the shield 400 comprises an interior shield 402 that is at least partially embedded within the housing walls 434 of the interior housing 430. For example, at least some of the housing walls 434 of the interior housing 430 may comprise an exterior wall portion 434B and an interior wall portion 434A. At least a portion of the interior shield 402 may be sandwiched and/or disposed between the exterior wall portion 434B and the interior wall portion, 434A in an example embodiment.

In an example embodiment, the housing walls 434 define a first hollow cylinder enclosed at both ends. In an example embodiment, the diameter of the first hollow cylinder is greater than the length of the first hollow cylinder. In an example embodiment, the housing walls 434 that enclose the ends of the first hollow cylinder comprise an exterior wall portion 434B and an interior wall portion 434A, where the interior wall portion 434A faces the action chamber 432 and the exterior wall portion 434B faces out into the main chamber 442. In various embodiments, the interior shield 402 also generally defines a second hollow cylinder enclosed at both ends. The portions of the interior shield 402 that enclose the ends of the second hollow cylinder are embedded, sandwiched, and/or disposed between the interior wall portion 434A and the exterior wall portion 434B that enclose the ends of the first hollow cylinder of the interior housing 430. In an example embodiment, the cylinder portion of the second hollow cylinder lines the housing walls 434 of the cylinder portion of the first hollow cylinder facing into the action chamber 432. In various embodiments, the portions of the interior shield 402 that enclose the ends of the second hollow cylinder and the cylinder portion of the interior shield 402 are in direct electrical communication with each other. For example, the portions of the interior shield 402 that enclose the ends of the second hollow cylinder and the cylinder portion of the interior shield 402 may be made of a continuous piece of material and/or made of multiple pieces of the same material and in direct physical connection with one another. For example, a portion of the interior shield 402 that encloses an end of the second hollow cylinder may abut and/or be in direct physical contact with the cylinder portion of the interior shield 402.

In various embodiments, the interior shield 402 comprises one or more sheets of one or more first materials. For example, one or more sheets of the first materials may be used to form the hollow cylinder portion and the end enclosing portions of the interior shield 402. In various embodiments, the first materials are metals, metal alloys, and/or the like. In various embodiments, the interior shield 402 is made of a first material that has low resistivity at the action temperature. As used herein the term low resistivity refers to a resistivity of less than approximately $6\times10^{-8}$ ohm·m. In an example embodiment, the term low resistivity refers to a resistivity of less than approximately $2.8\times10^{-8}$ ohm·m. In an example embodiment, the term low resistivity refers to a resistivity of less than approximately $1.0\times10^{-8}$ ohm·m. In an example embodiment, a material with low resistivity may have a resistivity that is less than approximately $5\times10^{-9}$ ohm·m. In various embodiments, the interior shield 402 is made of a first material that has low resistivity at the action temperature. In various embodiments, the interior shield 402 is made of a first material that is a superconductor at the action temperature. As used herein the term superconductor refers to a resistivity of approximately zero. For example, the interior shield 402 may comprise one or more layers of a first material that has low resistivity and/or is a super conductor at the action temperature. For example, in an example embodiment, the action temperature is a cryogenic temperature (e.g., less than approximately 124 K). In various embodiments, the first materials may comprise one of and/or a combination of one or more of Al, Bi, Cd, Diamond:B, Ga, Hf, α-Hg, β-Hg, In, Ir, α-La, β-La, Li, Mo, Nb, Os, Pa, Pb, Re, Rh, Ru, Si:B, Sn, Ta, Tc, α-Th, Ti, Tl, α-U, β-U, V, α-W, β-W, Zn, Zr, $Ba_8Si_{46}$, $C_6Ca$, $C_6Li_3Ca_2$, $C_8K$, $C_8KHg$, $C_6K$, $C_3K$, $C_3Li$, $C_2Li$, $C_3Na$, $C_2Na$, $C_8Rb$, $C_6Sr$, $C_6Yb$, $C_{60}Cs_2Rb$, $C_{60}Cs_2Rb$, $C_{60}RbX$, $FeB_4$, InN, $In_2O_3$, $LaB_6$, $MgB_2$, $Nb_3A_1$, $Nb_3Ge$, NbO, NbN, $Nb_3Sn$, NbTi, SiC:B, SiC:Al, TiN, $V_3Si$, $YB_6$, ZrN, $ZrB_{12}$, YBCO, GdBCO, BSCCO, HBCCO ($HgBa_2Ca_2Cu_3O_x$), SmFeAs(O,F), CeFeAs(O,F), LaFeAs(O,F)), LaFePO, FeSe, $(Ba,K)Fe_2As_2$, NaFeAs, ReBCO, and/or other super conducting materials.

In an example embodiment, the interior housing 430 is assembled with the interior shield 402 sandwiched therein. For example, the interior shield 402 may be at least partially sandwiched between layers of the interior housing 430. In an example, embodiment, the interior shield 402 is annealed and/or heat-treated after the fabrication thereof. The interior housing 430 may then be assembled (e.g., using one or more fasteners) with the interior shield 402 embedded therein.

In various embodiments, one end of the interior shield 402 is enclosed at least in part by an end shield 404. In various embodiments, the end shield 404 is generally planar. The interior shield 402 may comprise a hollow cylindrical portion that is sandwiched, at least in part, within layers of the walls of the interior housing 430. In an example embodiment, the interior shield 402 may further comprise an end shield 404 that encloses one end of the how cylindrical portion of the interior shield 402. In an example embodiment, the end shield 404 may also be sandwiched, at least in part, between layers of the walls of the interior housing 430. In various embodiments, the end shield 404 may include one or more support openings 421 configured to allow support legs 42 to pass therethrough. In various embodiments, the end shield 424 may include a central opening 423 configured to provide optical access to the interior of the interior housing 430.

In various embodiments, the cryogenic chamber 40 comprises an outer housing 440 that defines a main chamber 442 of the cryogenic chamber 40. For example, the interior housing 430 and the action chamber 432 are disposed within the main chamber 442 of the cryogenic chamber 40. In various embodiments, an exterior shield 412 is disposed outside of the outer housing 440. For example, the exterior shield 412 may comprise one or more sheets of a second material that dads the outer surface 441 of the outer housing 440. For example, the exterior shield 412 may generally define a cylindrical shell that is disposed on the outer surface 441 of the outer housing 440. For example, the exterior shield 412 may be secured to the outer surface 441 of the outer housing 440.

In various embodiments, the exterior shield 412 is made of one or more second materials (e.g., one or more sheets of the second material(s)). In various embodiments, the second material(s) comprise a metal, metal alloy, and/or other low resistivity material and/or a thermally conductive material. In various embodiments, the exterior shield 412 may comprise at least one thermally conductive layer and at least one low resistivity layer. The thermally conductive layer(s) and the low resistivity layer(s) may be made of different materials. In various embodiments, the second material may be different from the first material of the interior shield 402. In various embodiments, the exterior shield 412 is expected to be at an outer shield temperature when the action chamber 432 is maintained at the action temperature (e.g., by the cryogenic system 45). In various embodiments, the second material has a low resistivity, and/or is a superconductor at the outer shield temperature. In an example embodiment, the outer shield temperature is in the range of approximately 30-100K. In an example embodiment, the outer shield temperature is approximately 40 K.

In various embodiments, one or more intermediate shields 422 (e.g., 422A, 422B) may be disposed between the outer housing 440 and the interior housing 430. For example, an intermediate shield 422 may be disposed within the main chamber 442 and outside of the interior housing 430. In an example embodiment, two intermediate shields 422A, 422B are disposed between the outer housing 440 and the interior housing 430. In an example embodiment, the at least one of the intermediate shields 422B is not in direct contact with the outer housing 440 and/or interior housing 430. For example, the intermediate shield 422B may be secured to the outer housing 440, interior housing 430, and/or another intermediate shield 422A via one or more spacers 450. In an example embodiment, two or more intermediate shields 422A, 422B may indirect contact with one another via one or more spacers 450. In an example embodiment, mechanical fasteners 452 are used to secure the spacers 450 to the exterior shield 412, intermediate shield(s) 422, and/or outer housing 440. In an example embodiment, one of the intermediate shields 422B is secured directly to the interior surface (e.g., the main chamber 442 facing surface) of the outer housing 440. For example, one of the intermediate shields 422B dads the interior surface of the hollow cylinder defined by the outer housing 440.

In various embodiments, the intermediate shields 422 each generally define a hollow cylinder. In various embodiments, the intermediate shield(s) 422 comprise one or more sheets of a third material. The third material(s) may be a metal, metal alloy, and/or other low resistivity material and/or a thermally conductive material. In various embodiments, the exterior shield 412 may comprise at least one thermally conductive layer and at least one low resistivity layer. The thermally conductive layer(s) and the low resistivity layer(s) may be made of different materials. In various embodiments, at least one of the third material(s) may be different from the first material(s) of the interior shield and/or the second material(s) of the outer shield. In various embodiments, an intermediate shield 422 is expected to be at an intermediate temperature when the action chamber is maintained at the action temperature (e.g., by the cryogenic system 45). In various embodiments, one of the third materials has a low resistivity and/or is a superconductor at the intermediate temperature. In an example embodiment, the intermediate temperature is in the range of approximately 30-100K. In an example embodiment, the intermediate temperature is approximately 40 K.

In various embodiments, the first, second, and/or third materials may comprise mumetal or other magnetic shield alloy (e.g., a metal alloy having a high magnetic permeability). In various embodiments, the first, second, and/or third materials may comprise a heat-treated mumetal or other magnetic shield alloy (e.g., a metal alloy having a high magnetic permeability).

In various embodiments, the interior shield 402, exterior shield 412, and one or more intermediate shields 422 each define a hollow cylinder. In various embodiments, the hollow cylinders of each of the interior shield 402, exterior shield 412, and one or more intermediate shields 422 are coaxial. For example, in a cross-section of the shield 400 taken substantially perpendicular to any of an axis defined by the interior shield 402, an axis defined by the exterior shield 412, and/or an axis defined by an intermediate shield 422 (and/or top view of the shield 400, as shown, for example, in FIG. 6) a cross-section of the interior shield, a cross-section of the exterior shield 412, and a cross-section of the intermediate shield(s) 422 are concentric.

In various embodiments, the interior housing 430 and outer housing 440 include or more access openings 436, 446. In various embodiments, the access openings 436, 446 may provide an optical path for a laser beam to enter the action chamber 432 for use in the action, provide an optical path for photons generated during the action to leave the action chamber 432, permit a fiber optic or electrical cable to pass through the outer and/or interior housing 440, 430, and/or the like. In various embodiments, the interior, outer, and/or intermediate shields 402, 412, 422 comprise shield openings 406, 416, 426 corresponding to access openings 436, 446. For example, the interior shield 402 comprises a shield opening 406 corresponding to each access opening 436 of the interior housing 430. For example, the exterior shield 412 comprises a shield opening 416 corresponding to each access opening 446 of the outer housing 440. In various embodiments, an intermediate shield 422 may comprise a shield opening 426 corresponding to each access opening of the interior and/or outer housing 430, 440. In an example embodiment, the interior shield 402, intermediate shield 422, and/or exterior shield 412 comprises a tube stub 408, 418 extending outward from the shield opening 406, 416, 426. For example, a tube stub 408, 418 may be hollow cylinder having substantially the same diameter as the corresponding shield opening 406, 416, 426. The tube stub 408, 418 may be secured to the corresponding shield (e.g., interior shield 402 and/or exterior shield 418) at the perimeter of the shield opening 406, 416 and extend outward for a tube length. In various embodiments, the tube stub 408, 418 defines a tube diameter. The tube length may be at least approximately three times the tube diameter. In an example embodiment, the tube length may be determined based on other components of the system that are in the vicinity of the shield opening 406, 416, 426. For example, the tube stub 408, 418 may have a tube length configured to permit optical components to be able to provide an optical signal into the action chamber 432 via the shield opening 406, 416, 426. In various embodiments, a tube stub 408, 418 is made of the same material as the corresponding shield.

In an example embodiment, it may be desired to maintain a particular magnetic field within at least a portion of the action chamber 432. In various embodiments, Helmholtz/drive coils, permanent magnets, shim coils, and/or the like are disposed outside of the cryogenic chamber 40. Thus, heat generated by the Helmholtz/drive coils, shim coils, and/or the like does not affect the temperature within the main chamber 442 and/or the action chamber 432 as the heat may be dissipated into the environment outside of the cryogenic chamber 40.

In an example embodiment, Helmholtz/drive coils, permanent magnets, shim coils, and/or the like are disposed within the main chamber 442 (but exterior to the action chamber 432). In such an example embodiment, the Helmholtz/drive coils, permanent magnets, shim coils, and/or the like are expected to be at a third temperature when the action chamber 432 is maintained at the action temperature. In various embodiments, the Helmholtz/drive coils, shim coils, and/or the like may be made of and/or comprise a material that has low resistivity and/or acts as a superconductor at the outer shield temperature, intermediate temperature, and/or action temperature.

As shown in FIG. 8, in an example embodiment, Helmholtz/drive coils 462, permanent magnets, shim coils 464, and/or the like are disposed within the action chamber 432. In such an example embodiment, the Helmholtz/drive coils, permanent magnets, shim coils, and/or the like are expected to be at the action temperature when the action chamber 432 is maintained at the action temperature. In various embodiments, the Helmholtz/drive coils 462, shim coils 464, and/or the like may be made of and/or comprise a material that has low resistivity and/or acts as a superconductor at the action temperature. For example, if the Helmholtz/drive coils 462, shim coils 464, and/or the like comprise and/or are made of a material (e.g., the first material, in an example embodiment) that acts as a superconductor at the action temperature, the Helmholtz/drive coils 462, shim coils 464, and/or the like will generate very little to no heat during operation (e.g., because the resistivity of the Helmholtz/drive coils and/or shim coils will be approximately zero). Thus, operation of the Helmholtz/drive coils 462, shim coils 464, and/or the like will not cause significant heating within the action chamber 432. This allows for the desired magnetic field for the action chamber 432 to be generated within the action chamber 432 (e.g., within the interior shield 402), which results in a very precise, highly uniform magnetic field region within the action chamber 432.

Technical Advantages

Various embodiments provide technical solutions to the technical problem of maintaining a region within a cryogenic chamber that has a very uniform and/or homogenous magnetic field. In various embodiments, the technical solution for providing a region having a highly uniform and/or homogenous magnetic field includes incorporating a shield 400 into the cryogenic chamber 40 to shield an action chamber 432 and/or main chamber 442 of the cryogenic chamber 40 from stray magnetic fields, fluctuations in magnetic fields in the environment outside of the cryogenic chamber 40, and/or the like. In various embodiments, the shield 400 comprises an interior shield 402 at least partially embedded within the housing walls 434 of the interior housing 430 of a cryogenic chamber 40. For example, at least a portion of the interior shield 402 may be sandwiched and/or disposed between the exterior wall portion 434B and the interior wall portion 434A of the interior housing 430. In an example embodiment, a portion of the interior shield 402 is disposed on and/or abutting a face of the housing wall 434 that faces into the action chamber 432. For example, the housing walls 434 may define a hollow cylinder enclosed on the ends. The interior shield 402 may be sandwiched and/or disposed between the exterior wall portion 434B and the interior wall portion 434A of the interior housing 430 on the enclosing ends and disposed on the action-chamber-432-facing side of the housing wall 434 on the how cylinder portion of the interior housing 430. This positioning of the interior shield 402 ensures that the interior shield will be maintained at the action temperature when the action chamber 432 is maintained at the action temperature. In various embodiments, the interior shield 402 is made of one or more first materials and at least one of the first materials has a low resistivity and/or is a superconductor at the action temperature. Thus, the interior shield 402 provides very high quality magnetic field shielding for the action chamber 432.

In various embodiments, the shield 400 further comprises an exterior shield 412 and/or one or more intermediate shields 422. In various embodiments, the interior shield 402 comprises one or more tube stubs 408 about a shield opening 406 therein. In various embodiments, the exterior shield 412 and/or the intermediate shield 422 comprises one or more tube stubs 418 about a shield opening 416, 426 therein. The tube stubs 408, 418 act to control, shield, and/or condition the magnetic field in the vicinity of the shield openings 406, 416, 426 so as to diminish and/or minimize the disruption to the shielding abilities of the interior shield 402, exterior shield 412, and/or intermediate shield(s) 422 caused by the shield openings 406, 416, 426.

Thus, various embodiments provide a shield 400 that is configured to provide a very homogenous magnetic field region within the action chamber 432. For example, the shield 400 may be configured to reduce, diminish, and/or minimize magnetic field fluctuations within the action chamber 432. The ability to have the Helmholtz/drive coils 462, shim coils 464, and/or the like within the action chamber 432 (e.g., inside the interior shell 402) further allows for a highly precise and uniform magnetic field region to be established and/or maintained within the action chamber 432, without having a significant effect on the temperature within the action chamber 432.

Exemplary Controller

In various embodiments, the controller 30 may comprise various controller elements including processing elements, memory, driver controller elements, analog-digital converter elements, and/or the like. For example, the processing elements may comprise programmable logic devices (CPLDs), microprocessors, coprocessing entities, application-specific instruction-set processors (ASIPs), integrated circuits, application specific integrated circuits (ASICs), field programmable gate arrays (FPGAs), programmable logic arrays (PLAs), hardware accelerators, other processing devices and/or circuitry, and/or the like. and/or controllers. The term circuitry may refer to an entirely hardware embodiment or a combination of hardware and computer program products. For example, the memory may comprise non-transitory memory such as volatile and/or non-volatile memory storage such as one or more of as hard disks, ROM, PROM, EPROM, EEPROM, flash memory, MMCs, SD memory cards, Memory Sticks, CBRAM, PRAM, FeRAM, RRAM, SONOS, racetrack memory, RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. In various embodiments, the driver controller elements may include one or more drivers and/or controller elements each configured to control one or more drivers.

In various embodiments the drivers may be laser drivers; vacuum component drivers; drivers for controlling the flow of current and/or voltage applied to DC, RD, and/or other electrodes used for maintaining and/or controlling the ion trapping potential of the ion trap 50; cryogenic system component drivers; and/or the like. In various embodiments, the controller 30 comprises means for communicating and/or receiving signals from one or more optical receiver components such as cameras, MEMs cameras, CCD cameras, photodiodes, photomultiplier tubes, and/or the like. For example, the controller 30 may comprise one or more analog-digital converter elements configured to receive signals from one or more optical receiver components. In various embodiments, the controller 30 may comprise means for receiving executable instructions, command sets, and/or the like from the computing entity 10 and providing output received from the quantum computer 110 (e.g., from an optical collection system) and/or the result of a processing the output to the computing entity 10. In various embodiments, the computing entity 10 and the controller 30 may communicate via a direct wired and/or wireless connection and/or one or more wired and/or wireless networks 120.

Exemplary Computing Entity

FIG. 9 provides an illustrative schematic representative of an example computing entity 10 that can be used in conjunction with embodiments of the present invention. In various embodiments, a computing entity 10 is configured to allow a user to provide input to the quantum computer system 100 (e.g., via a user interface of the computing entity 10) and receive, view, and/or the like output from the quantum computer system 100.

As shown in FIG. 9, a computing entity 10 can include an antenna 312, a transmitter 304 (e.g., radio), a receiver 306 (e.g., radio), and a processing element 308 that provides signals to and receives signals from the transmitter 304 and receiver 306, respectively. The signals provided to and received from the transmitter 304 and the receiver 306, respectively, may include signaling information/data in accordance with an air interface standard of applicable wireless systems to communicate with various entities, such as a controller 30, other computing entities 10, and/or the like. In this regard, the computing entity 10 may be capable of operating with one or more air interface standards, communication protocols, modulation types, and access types. For example, the computing entity 10 may be configured to receive and/or provide communications using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, the computing entity 10 may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000 1×(1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), Wi-Fi Direct, 802.16 (WiMAX), ultra wideband (UWB), infrared (IR) protocols, near field communication (NFC) protocols, Wibree, Bluetooth protocols, wireless universal serial bus (USB) protocols, and/or any other wireless protocol. The system computing entity 20 may use such protocols and standards to communicate using Border Gateway Protocol (BGP), Dynamic Host Configuration Protocol (DHCP), Domain Name System (DNS), File Transfer Protocol (FTP), Hypertext Transfer Protocol (HTTP), HTTP over TLS/SSL/Secure, Internet Message Access Protocol (IMAP), Network Time Protocol (NTP), Simple Mail Transfer Protocol (SMTP), Telnet, Transport Layer Security (TLS), Secure Sockets Layer (SSL), Internet Protocol (IP), Transmission Control Protocol (TCP), User Datagram Protocol (UDP), Datagram Congestion Control Protocol (DCCP), Stream Control Transmission Protocol (SCTP), HyperText Markup Language (HTML), and/or the like.

Via these communication standards and protocols, the computing entity 10 can communicate with various other entities using concepts such as Unstructured Supplementary Service information/data (USSD), Short Message Service (SMS), Multimedia Messaging Service (MMS), Dual-Tone Multi-Frequency Signaling (DTMF), and/or Subscriber Identity Module Dialer (SIM dialer). The computing entity 10 can also download changes, add-ons, and updates, for instance, to its firmware, software (e.g., including executable instructions, applications, program modules), and operating system.

The computing entity 10 may also comprise a user interface device comprising one or more user input/output interfaces (e.g., a display 316 and/or speaker/speaker driver coupled to a processing element 308 and a touch screen, keyboard, mouse, and/or microphone coupled to a processing element 308). For instance, the user output interface may be configured to provide an application, browser, user interface, interface, dashboard, screen, webpage, page, and/or similar words used herein interchangeably executing on and/or accessible via the computing entity 10 to cause display or audible presentation of information/data and for interaction therewith via one or more user input interfaces. The user input interface can comprise any of a number of devices allowing the computing entity 10 to receive data, such as a keypad 318 (hard or soft), a touch display, voice/speech or motion interfaces, scanners, readers, or other input device. In embodiments including a keypad 318, the keypad 318 can include (or cause display of) the conventional numeric (0-9) and related keys (#, *), and other keys used for operating the computing entity 10 and may include a full set of alphabetic keys or set of keys that may be activated to provide a full set of alphanumeric keys. In addition to providing input, the user input interface can be used, for example, to activate or deactivate certain functions, such as screen savers and/or sleep modes. Through such inputs the computing entity 10 can collect information/data, user interaction/input, and/or the like.

The computing entity 10 can also include volatile storage or memory 322 and/or non-volatile storage or memory 324, which can be embedded and/or may be removable. For instance, the non-volatile memory may be ROM, PROM, EPROM, EEPROM, flash memory, MMCs, SD memory cards, Memory Sticks, CBRAM, PRAM, FeRAM, RRAM, SONOS, racetrack memory, and/or the like. The volatile memory may be RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. The volatile and non-volatile storage or memory can store databases, database instances, database management system entities, data, applications, programs, program modules, scripts, source code, object code, byte code, compiled code, interpreted code, machine code, executable instructions, and/or the like to implement the functions of the computing entity 10.

CONCLUSION

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A shield for a cryogenic chamber, the shield comprising:

an interior shield at least partially sandwiched within housing walls of the cryogenic chamber, the housing walls defining an action chamber, the action chamber configured to be cryogenically cooled to an action temperature, wherein the interior shield is made of a first material that acts as a superconductor at the action temperature, the interior shield comprising one or more shield openings and at least one of the one or more shield openings comprises a tube stub extending outward from the interior shield, the tube stub made of the material and in electrical contact with the interior shield;

an outer shield at least partially enclosing a main chamber, the interior shield disposed within the main chamber; and an intermediate shield disposed within the main chamber and exterior to the interior shield.

2. The shield of claim 1, wherein the action temperature is a cryogenic temperature.

3. The shield of claim 1, wherein the interior shield is made of one or more metal sheets.

4. The shield of claim 1, wherein the outer shield comprises one or more shield openings and at least one of the one or more shield openings comprises a tube stub extending outward from the outer shield, the tube stub made of the material and in electrical contact with the outer shield.

5. A cryogenic chamber comprising a shield, the cryogenic chamber comprising:

an interior housing comprising housing walls that define an action chamber, the action chamber configured to be cryogenically cooled to an action temperature;

an interior shield at least partially sandwiched within the housing walls, the interior shield made of a first material that acts as a superconductor at the action temperature, the interior shield comprising one or more shield openings and at least one of the one or more shield openings comprises a tube stub extending outward from the interior shield, the tube stub made of the material and in electrical contact with the interior shield; and at least one of (a) one or more drive coils or (b) one or more shim coils within and/or associated with the action chamber.

6. The cryogenic chamber of claim 5, wherein the interior housing comprises one or more access openings that each correspond to a respective one of the one or more shield openings.

7. The cryogenic chamber of claim 6, wherein the tube stub extends out through a corresponding access opening of the one or more access openings.

8. The cryogenic chamber of claim 6, wherein the action temperature is a cryogenic temperature.

9. The cryogenic chamber of claim 5, wherein the at least one of (a) one or more drive coils or (b) one or more shim coils comprises a material that acts as a superconductor at the action temperature.

10. The cryogenic chamber of claim 5, wherein the housing walls are made of metal.

11. The cryogenic chamber of claim 5, further comprising an outer housing defining a main chamber, the interior housing being within the main chamber.

12. The cryogenic chamber of claim 11, further comprising an outer shield cladding an exterior of the outer housing.

13. The cryogenic chamber of claim 12, further comprising an intermediate shield disposed within the main chamber and exterior to the interior housing.

14. The cryogenic chamber of claim 12, wherein the outer shield comprises one or more shield openings and at least one of the one or more shield openings comprises a tube stub extending outward from the outer shield, the tube stub in electrical contact with the outer shield.

15. The cryogenic chamber of claim 14, wherein the tube stub defines a tube diameter and tube length and the tube length is at least approximately three times the tube diameter.

16. A shield for a cryogenic chamber, the shield comprising:

an outer shield; and an interior shield disposed at least partially within the outer shield and configured to have an action chamber of the cryogenic chamber disposed therein, the action chamber configured to be cryogenically cooled to an action temperature, wherein the interior shield is made of a first material that acts as a superconductor at the action temperature, the outer shield and the interior shield each comprise one or more respective shield openings and the one or more shield openings each comprise a respective tube stub extending outward from a respective one of the outer shield or the interior shield, the respective tube stub in electrical contact with the respective one of the outer shield or the interior shield.

17. The shield of claim 16, further comprising an intermediate shield disposed between the interior shield and the outer shield.

18. The shield of claim 17, wherein the intermediate shield comprises one or more intermediate shield openings corresponding to the one or more respective shield openings of the outer shield and the interior shield.

19. The shield of claim 16, wherein the respective tube stub defines a tube diameter and tube length and the tube length is at least approximately three times the tube diameter.

* * * * *